US006966514B2

(12) United States Patent
Dressler

(10) Patent No.: US 6,966,514 B2
(45) Date of Patent: Nov. 22, 2005

(54) DEVICE FOR DECURLING A SHEET OF PAPER TAKEN FROM A ROLL

(75) Inventor: Donald R. Dressler, Glastonbury, CT (US)

(73) Assignee: Hunt Holdings, Inc., Wilmington, DE (US)

( * ) Notice: Subject to any disclaimer, the term of this patent is extended or adjusted under 35 U.S.C. 154(b) by 11 days.

(21) Appl. No.: 10/663,576

(22) Filed: Sep. 16, 2003

(65) Prior Publication Data

US 2004/0050989 A1 Mar. 18, 2004

Related U.S. Application Data

(60) Provisional application No. 60/411,826, filed on Sep. 18, 2002.

(51) Int. Cl.[7] ..... B65H 18/28

(52) U.S. Cl. ..... 242/160.2; 242/528; 242/530.2; 242/602; 40/904

(58) Field of Search ..... 242/602, 536, 242/160.2, 530.2, 528; 206/410, 412, 449; 40/514, 904

(56) References Cited

U.S. PATENT DOCUMENTS 986,054 A * 3/1911 Griffin ..... 242/160.2
1,555,950 A * 10/1925 Fauteux ..... 242/160.2
2,715,788 A * 8/1955 Gutshall ..... 242/530.2
3,806,574 A * 4/1974 Arvidson ..... 264/160
4,026,485 A * 5/1977 Ambrose ..... 242/530.2
4,258,846 A * 3/1981 Campo ..... 206/412
5,375,707 A * 12/1994 Richer ..... 206/410
5,566,906 A * 10/1996 Kamada et al. ..... 242/563
5,795,512 A * 8/1998 Greener et al. ..... 264/40.6
6,416,013 B1 * 7/2002 Benzing ..... 242/536
6,755,370 B2 * 6/2004 Volpi ..... 242/528

* cited by examiner

*Primary Examiner*—Emmanuel Marcelo
(74) *Attorney, Agent, or Firm*—Alix, Yale & Ristas, LLP

(57) ABSTRACT

The invention is directed to a roll assembly comprising an elongated, substantially rigid, cylindrical roll; a carrier sheet wrapped around the roll, having an inner edge attached to the roll in parallel with the roll axis and upper and lower surfaces with opposed longitudinal edges extending perpendicularly to the roll axis; and a friction strip extending along each longitudinal edge of the upper surface of the carrier sheet, wherein the coefficient of friction of the strips is greater than the coefficient of friction of the upper surface of the carrier sheet. The carrier sheet attached to the roll is preferable a plastic film made of polyester or polycarbonate having a thickness in the range of 5 to 15 mils. This sheet may be made up of one film sheet or multiple sheets. Soft, tacky, rubber friction strips are attached along the longitudinal edges of the upper surface of the sheet and can be is from approximately ½ inch to 2 inches in width and approximately 10 to 30 mils in thickness running for substantially the entire length of the film carrier sheet.

20 Claims, 2 Drawing Sheets

DEVICE FOR DECURLING A SHEET OF PAPER TAKEN FROM A ROLL

RELATED APPLICATIONS

This is the regular U.S. patent application claiming the benefit of the Sep. 18, 2002 filing date of U.S. provisional application No. 60/411,826 under 35 U.S.C. §119(e).

BACKGROUND OF THE INVENTION

The present invention relates to the handling of printed sheets in the graphics industry.

Technology advances in the graphics industry have made it possible for individuals and companies to create and print there own output. Traditionally, this printing was performed by a dedicated print company with large, capital-intensive facilities requiring large quantity runs.

The recent availability of computers, digital cameras, and high quality printers (both desktop and larger stand-alone) have made it cost effective to print on demand with very small required runs. These new printers center around ink jet technology. Small printers use primarily sheets of paper in the range of 8½×11 to 11×17 inches. Larger ink jet printers can print images having a length dimension of 2–6 feet and primarily use rolls of paper. The market for these large printers is being driven by demand for in-store graphics, trade show graphics and fine art and photography limited-edition prints. The roll paper for these applications vary in construction from traditional poly-coated photographic paper to 100% cotton rag fine art paper. The papers are usually put on a small 2–3 inch diameter roll (core) and may be 5 yards to 20 yards in length. All these papers have some degree of roll set or curl to them when taken off a roll. There has been no reliable way to take the curl out of these papers either before or after they are printed.

Much of this printed paper output is sold to artists or photographers who frame the prints for the art market. Many of the large "non art" prints are processed by mounting and/or protecting the imaged surface by over-laminating with clear, thin films. In any case, a flat print is certainly easier to process and store.

Present attempts to take the curl out of printed sheets include wetting the back of the sheet of the paper to re-orient the paper fibers and let the sheet dry in a flat plane. This is time consuming, messy and risky since the printing inks may be water based (ink jet) and subject to water damage. One may put a flat weight on the curled print and wait 24 hours. This works to some degree but is time consuming and will never give a perfectly flat print. Some have tried to re-roll the print by itself and stick it in the center of an empty three-inch paper roll core. This does not work well because it is very difficult to roll the paper against the curl without kinking it. Even if one is successful with re-rolling the paper and placing it in a tube center the paper will never come out flat, because the front and back edges for approximately six inches will not be de-curled by this method. The paper must also stay in this roll center for many hours to take some curl out. It is impossible to roll this heavy paper up by itself by hand in a small diameter roll like 1½ inches and not destroy the paper. This is a typical diameter needed to de-curl paper in seconds rather than hours.

SUMMARY OF THE INVENTION

The object of the present invention is to enable an operator of a graphic arts enterprise to print an image on paper and render the printed paper flat in seconds, so that it can be shown to a customer, shipped, sold, or further processed with reliability and speed. To accomplish this objective, a novel approach to de-curling has been invented.

In one aspect, the invention is directed to a roll assembly comprising an elongated, substantially rigid, cylindrical roll; a carrier sheet wrapped around the roll, having an inner edge attached to the roll in parallel with the roll axis and upper and lower surfaces with opposed longitudinal edges extending perpendicularly to the roll axis; and a friction strip extending along each longitudinal edge of the upper surface of the carrier sheet, wherein the coefficient of friction of the strips is greater than the coefficient of friction of the upper surface of the carrier sheet.

The preferred embodiment of the invention consists of a core roll with an attached carrier sheet that is larger than the printed product to be decurled, e.g., having a sheet length such that when unwrapped with the lower surface of the sheet overlying a flat work surface, the sheet extends transversely to the roll axis at least about ten times the roll diameter. The diameter of this roll can vary from approximately ½ inch to 3 inches depending on the type of paper and the extent of roll set (curl) on the product. The carrier sheet attached to the roll is preferable a plastic film made of polyester or polycarbonate having a thickness in the range of 5 to 15 mils. This sheet may be made up of one film sheet or multiple sheets. Soft, tacky, rubber friction strips are attached along the longitudinal edges of the upper surface of the sheet and can be from approximately ½ inch to 2 inches in width and approximately 10 to 30 mils in thickness running for substantially the entire length of the film carrier sheet. These strips are preferably adhesively adhered to the carrier sheet. The friction strips act as brakes when de-curling is taking place and stop the rolled up sheet from unrolling prematurely due to the tremendous force generated from a heavy paper de-curling in the roll. In the preferred embodiment these strips are made of 30–50 durometer silicone rubber with a high gloss surface.

Depending on the material of the carrier sheet, it may be desirable to include low-friction runner strips, such as low surface energy tape, on the back side longitudinal edges of the carrier sheet to assist in sliding of the assembly on the work table surface.

BRIEF DESCRIPTION OF THE DRAWING

The preferred embodiment of the invention will be described with reference to the accompanying drawing, in which.

DESCRIPTION OF THE PREFERRED EMBODIMENT

Figure 1:
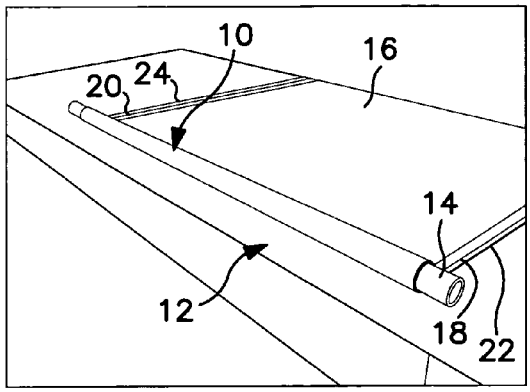
FIG. 1 is a perspective view of the roll assembly of the present invention, partially unwrapped such that the lower surface of the sheet lies on a work surface or table.

FIG. 1 shows the inventive roll 10 on a flat work table 12 or bench, with a very straight and smooth tubular core 14 and a sheet 16 of filmic material shown partially wound on the core and partially opened flat on the work table. Friction strips 18, 20 are shown along each lateral edge 22, 24 of the sheet. The inner edge of the sheet is secured (not shown) to the core to assure that it remains affixed to the core and at right angles to the core axis.

Figure 2:
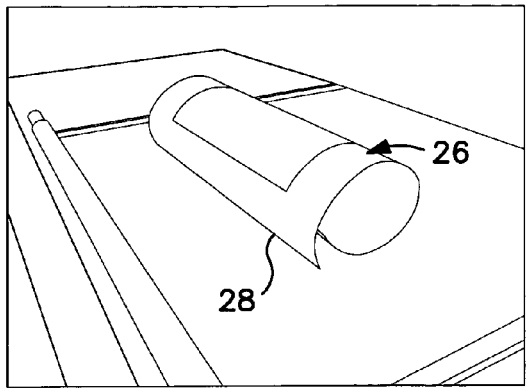
FIG. 2 is a view similar to FIG. 1, further including a graphic product exhibiting the inherent curling resulting from a typical printing process.
Figure 3:
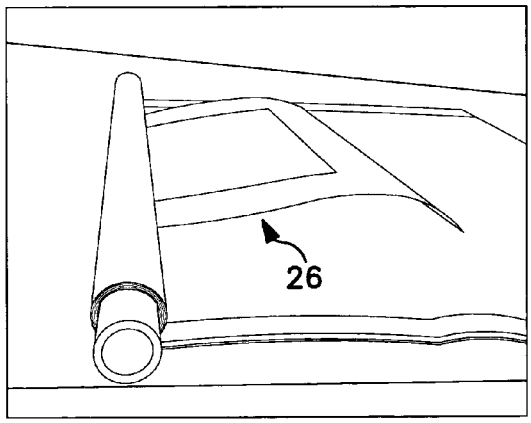
FIG. 3 shows the leading transverse edge of the graphic product and adjacent regions and trapped within the partially advanced roll during the initial stages of the decurling of the graphic product.
Figure 4:
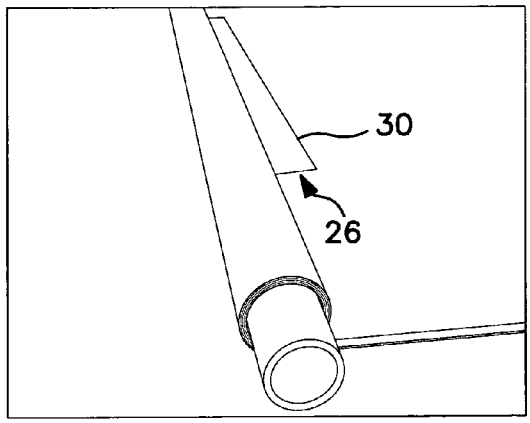
FIG. 4 shows a recondition of the decurling process subsequent to the condition shown in FIG. 3, and approaching the complete entrapment of the graphic product of the roll.
Figure 5:
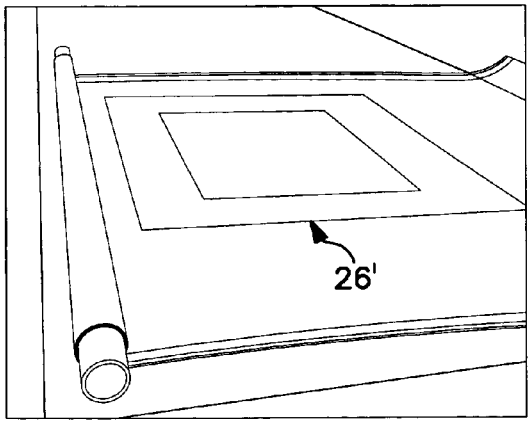
FIG. 5 shows a completion of the decurling processing, after the complete entrapment following the condition shown in FIG. 4 and the subsequent complete unwrapping to expose the entire graphic product which has now achieved a permanently flattened state.

FIG. 2 shows a printed sheet 26 exhibiting a natural curl about a curl axis as it emerges from a printer. According to the inventive method as depicted in FIGS. 3 and 4, one (bottom) edge 28 of the printed sheet is inserted at or positioned near the wedge at the circumference of the rolled portion of the sheet where the sheet extends at a tangent. The operator lays his or her palms in spaced apart relation toward opposite axial ends of the roll, and begins rolling the assembly with printed sheet, analogous to the use of a rolling pin, such that the printed sheet is captured within and rolled according to the radius of curvature of the rolled portion of the sheet on the tube core. The sheet is fully rolled beyond the exposed top edge 30 of the print 26 as shown in FIG. 4. Thus, the printed graphic is rolled and fully entrapped within the wrapped sheet of the roll assembly. After the print is held within the inventive roller device for a period measured in seconds or minutes, the operator merely reverses the rolling direction, exposing the flattened print 26' as shown in FIG. 5.

Figure 6:
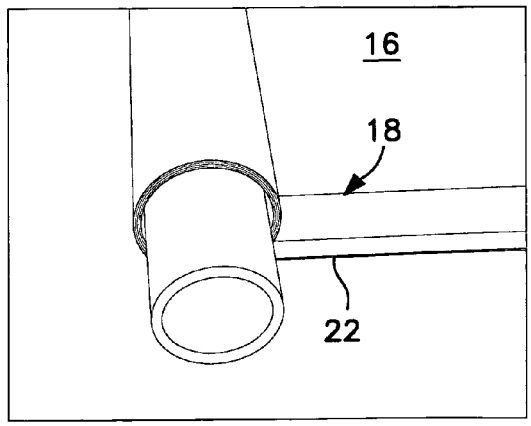
FIG. 6 is a detailed view of the partially unwrapped roll assembly, more clearly revealing the high-friction runner strip extending along one longitudinal edge of the sheet component of the roll assembly.

FIG. 6 is a detailed view showing the friction strip 18 along one 22 of the two longitudinal edges of the roller carrier sheet 16.

The preferred features of the roll assembly will now be described in further detail. The cylindrical roll 14 can be a solid cylinder or tubular, with a length that is sufficient to accommodate a variety of graphic product widths, with three to four feet representing a desirable typical length. For most uses, the roll diameter should be up to about three inches. The region of the sheet along the inner edge running parallel to the roller axis is preferably adhesively, or otherwise, attached to the roll, and has longitudinal edges defining the length of the sheet, which is preferably at least 10 up to 25 times the roll diameter. The roll should be relatively rigid, smooth, and uniformly round, with the portions at the axial ends extending beyond the width dimension of the sheet.

As shown in FIGS. 2, 3 and 4, the printed graphic is placed with the substrate on the upper surface of the sheet, thereby exposing the printed image to the operator, oriented so that the curl axis of the printed graphic is substantially parallel to the axis of the roll. The carrier sheet is preferably a plastic, but can be paper, with a total thickness preferably in the range of about 5–30 mils. The upper surface of the sheet, on which the printed graphic is placed, has an inherent coefficient of friction with respect to the coefficient friction of the bottom surface of the sheet. As indicated previously, the sheet can be a composite or laminate of two or more layers. During the rolling operation, represented by FIGS. 3 and 4, the forces associated with decurling the printed graphic would normally overcome the frictional force associated with the interface between the upper and lower surfaces of the sheet during rolling, such that it would be difficult if not impossible to continue rolling up the graphic to achieve the condition shown in FIG. 4, let alone complete entrapment of the product within the rolled sheet resulting from several more complete circumferential rolls than represented in FIG. 4.

According to the preferred embodiment of the invention, the friction between the upper and lower surface of the sheet is enhanced by the friction strips 18, 20 that extend along each longitudinal edge of the upper surface of the carrier sheet. The coefficient of friction of the strips is greater than the coefficient of friction of the upper surface of the carrier sheet. The upper surface of the strips can be homogenous with the remainder of the strips, such as solid rubber or equivalent, or can be specially treated. An alternative to rubbery material is plastic foam material. Most conveniently, these strips are distinct components that are adhesively attached to the sheet with substantial projection from the sheet upper surface, but filmic material or coating can also be utilised under some circumstances.

Whereas it is desirable that a high friction be established between the upper surface of the sheet and the lower surface of the sheet during rolling, especially in the interaction of the friction strips with the underside of the sheet, it is desirable that the underside of the sheet have a low friction relationship with the work surface. This can be achieved in a number of ways, such as by selecting a composite sheet wherein the upper layer has a relatively high coefficient of friction and the lower layer has a low coefficient of friction. The operator can easily rotate the roll assembly while maintaining the roll assembly substantially stationary at a comfortable working distance while standing at the work surface.

Figure 7:
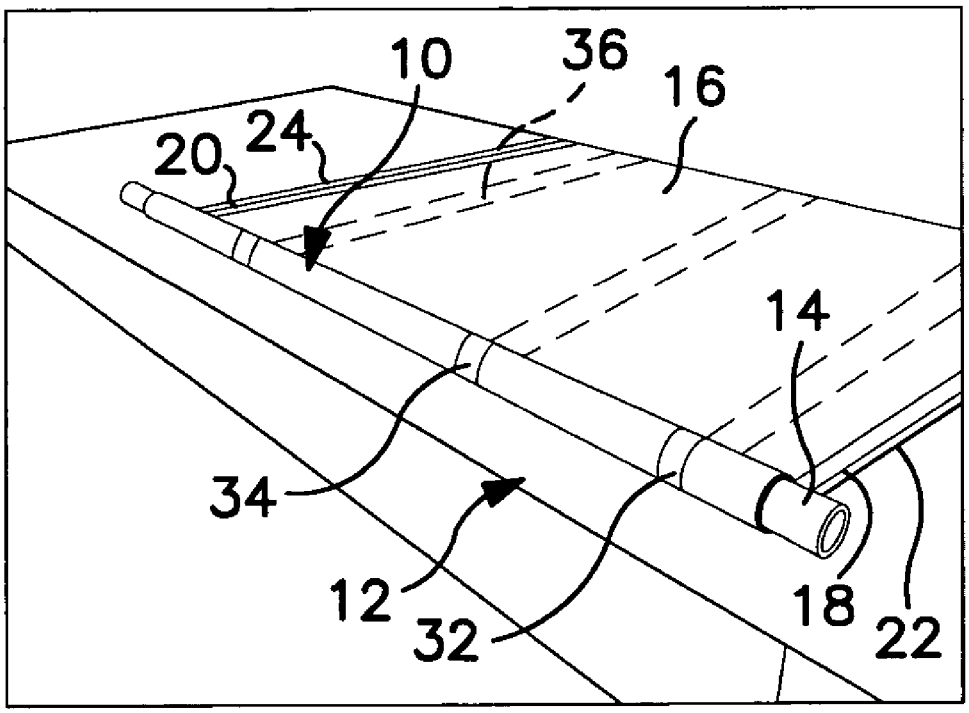
FIG. 7 is a view similar to FIG. 1, showing the low-friction runners in an alternative embodiment of the invention.

FIG. 7 is a view similar to FIG. 1, showing an alternative embodiment of the invention. Especially if the sheet 16 is of homogenous, non-slip material, the underside of the sheet can have a plurality, such as three, longitudinally extending slip runners 32, 34, 36, which, unlike the friction strips 18,20 on the upper surface, have a low coefficient of friction such that the rotating motion of the roll assembly maintains sliding contact with the work surface and thus enables the operator to rotate the roll without displacement of the roll axis. Such slip runners are located on the underside of the sheet offset from the axial locations of the friction strips.

The friction strips 18, 20 preferably have a thickness in the range of 10–30 mils, thereby defining a space or gap between successive circumferences formed as the roll assembly encapsulates the printed product. This spacing has the beneficial consequence of avoiding the inadvertent and undesirable embossing of the print by the leading edge 28 of the print as it overlays the following portions of the print during the first or second roll subsequent to the roll which initially captures the leading edge 28 of the print.

What is claimed is:

1. A roll assembly for decurling a printed graphic, comprising:

an elongated, substantially rigid, cylindrical roll;

a carrier sheet wrapped around the roll, having an inner edge attached to the roll in parallel with the roll axis and upper and lower surfaces with opposed longitudinal edges extending perpendicularly to the roll axis and defining a sheet length such that when unwrapped with the lower surface of the sheet overlying a flat work surface, the sheet extends transversely to the roll axis at least about ten times the roll diameter; and a friction strip permanently carried by and extending along each longitudinal edge of the upper surface of the carrier sheet, wherein the coefficient of friction of the strips is greater than the coefficient of friction of the upper surface of the carrier sheet.

2. The roll assembly of claim 1, wherein the carrier sheet is plastic or paper.

3. The roll assembly of claim 1, wherein the carrier sheet has a total thickness in the range of range of 5–30 mils.

4. The roll assembly of claim 1, wherein the upper surface of the friction strips comprises rubbery material.

5. The roll assembly of claim 1, wherein the upper surface of the friction strips comprises a foam material.

6. The roll assembly of claim 1, in combination with a flat work surface having a lower coefficient of friction than the coefficient of friction of the lower surface of the carrier sheet, whereby the roll assembly may be manually rotated without displacement, on the work surface.

7. The roll assembly of claim 1, wherein the friction strips project above the upper surface of the sheet, a distance in the range of about 10–30 mils.

8. The roll assembly of claim 1, including a plurality of slide strips having an upper surface attached to the lower surface of the carrier sheet, wherein the slide strips have a lower surface with a coefficient of friction that is less than the coefficient of friction of the lower surface of the carrier sheet.

9. The roll assembly of claim 1, wherein the roll is a metal tube.

10. The roll assembly of claim 1, wherein the roll is a plastic tube.

11. The roll assembly of claim 1, wherein the roll is a paper tube.

12. The roll assembly of claim 1, wherein the roll is a solid cylinder.

13. The roll assembly of claim 1, wherein the carrier sheet is a composite of laminated sheets of different materials.

14. The roll assembly of claim 13, wherein the upper surface of the composite sheet has a higher coefficient of friction than the lower surface of the composite sheet.

15. A roll assembly for decurling a printed graphic, comprising:

a cylindrical roll having a nominal diameter in the range of about ½ inch to 3 inches and an axial length greater than said nominal diameter;

a sheet wrapped around the roll, having an inner edge attached to the roll in parallel with the roll axis and upper and lower surfaces with opposed longitudinal edges defining a sheet length such that when unwrapped, the sheet extends transversely to the roll axis at least about ten times the roll diameter; and a friction strip permanently carried by and extending along each longitudinal edge of the sheet, wherein the strips have an upper surface with a coefficient of friction that is greater than the coefficient of friction of the upper surface of the carrier sheet.

16. The roll assembly of claim 15, further including a printed graphic rolled and fully entrapped within the wrapped sheet of the roll assembly.

17. A roll assembly for decurling a printed graphic, comprising:

an elongated, substantially rigid, cylindrical roll;

a sheet wrapped around the roll, having an inner edge attached to the roll in parallel with the roll axis and upper and lower surfaces with opposed longitudinal edges extending perpendicularly to the roll axis and defining a sheet length such that when unwrapped with the lower surface of the sheet overlying a flat work surface, the sheet extends transversely to the roll axis at least about ten times the roll diameter; and a friction strip permanently carried by and extending along each longitudinal edge of the upper surface of the carrier sheet, wherein the friction strip projects a height in the range of about 10–30 mm from the upper surface of the sheet.

18. The roll assembly of claim 17, wherein the coefficient of friction of the strips is greater than the coefficient of friction of the upper surface of the sheet.

19. The roll assembly of claim 18, further including a printed graphic rolled and fully entrapped within the wrapped sheet of the roll assembly.

20. The roll assembly of claim 17, further including a printed graphic rolled and fully entrapped within the wrapped sheet of the roll assembly.

* * * * *